US009814957B2

(12) United States Patent
Kettler et al.

(10) Patent No.: US 9,814,957 B2
(45) **Date of Patent: *Nov. 14, 2017**

(54) HOLDING APPARATUS FOR A NET OF A TABLE-TENNIS TABLE

(71) Applicant: Kettler International, Inc., Virginia Beach, VA (US)

(72) Inventors: Karin Kettler, Ense (DE); Joachim Kettler, Ense (DE)

(73) Assignee: Kettler International, Inc., Virginia Beach, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/284,710

(22) Filed: Oct. 4, 2016

(65) Prior Publication Data

US 2017/0021253 A1 Jan. 26, 2017

Related U.S. Application Data

(63) Continuation of application No. 13/543,389, filed on Jul. 6, 2012, now Pat. No. 9,480,897.

(30) Foreign Application Priority Data

Feb. 14, 2012 (DE) ..... 20 2012 001 494 U

(51) Int. Cl.

| | |
|---|---|
| ***A63B 61/04*** | (2006.01) |
| ***A63B 67/04*** | (2006.01) |
| *A63B 71/00* | (2006.01) |

(52) U.S. Cl.

CPC ..... *A63B 67/045* (2013.01); *A63B 71/0045* (2013.01)

(58) Field of Classification Search

CPC ..... A47B 25/00; A47B 3/087; A63B 67/04; A63B 61/00; A63B 61/02

USPC ..... 473/492, 490, 491, 496, 475, 493

See application file for complete search history.

(56) References Cited

U.S. PATENT DOCUMENTS

| | | | | |
|---|---|---|---|---|
| 2,769,636 | A * | 11/1956 | Finestone | A63B 67/04 16/365 |
| 3,190,649 | A | 6/1965 | Heisler | |
| 3,773,323 | A * | 11/1973 | Mirand | A63B 67/045 473/475 |
| 4,762,321 | A * | 8/1988 | Chang | A47B 25/003 108/115 |
| 5,713,807 | A * | 2/1998 | Montaldi | A63B 67/045 473/491 |

(Continued)

*Primary Examiner* — Aarti B Berdichevsky
*Assistant Examiner* — Christopher Glenn
(74) *Attorney, Agent, or Firm* — Bernard G. Pike; Pike IP Law, PLLC

(57) ABSTRACT

A holding device (4) for a net (6) of a table-tennis table with two playing area leaves (1, 2) and an underframe (3), wherein the holding apparatus (4) includes two holding units (5) which can be arranged on opposite sides of the two playing area leaves (1, 2), and wherein each of the holding units (5) can be attached on at least one of the playing area leaves (1, 2) or on the substructure (3) and can hold one end of the net (6) and wherein the holding apparatus (4) includes at least one blocking means (7) which is arranged on one of the holding units (5) and, in the mounted state of the holding device (4), can be transferred into a blocking position in which it abuts against the under surfaces of the two playing area leaves (1, 2).

4 Claims, 6 Drawing Sheets

(56) References Cited

U.S. PATENT DOCUMENTS

| | | | | |
|---|---|---|---|---|
| 5,769,744 | A * | 6/1998 | Merrill | A63B 67/045 473/493 |
| 5,816,957 | A | 10/1998 | Dadbeh | |
| 7,104,903 | B1 | 9/2006 | Chen | |
| 8,157,677 | B1 * | 4/2012 | Chen | A63B 67/045 211/13.1 |
| 9,480,897 | B2 * | 11/2016 | Kettler | A63B 67/045 |
| 2004/0266568 | A1 * | 12/2004 | Dadbeh | A63B 67/04 473/496 |
| 2007/0202971 | A1 * | 8/2007 | Vallon | A47B 25/003 473/496 |
| 2009/0176605 | A1 * | 7/2009 | Martinez Leon | A47B 3/0911 473/496 |

* cited by examiner

HOLDING APPARATUS FOR A NET OF A TABLE-TENNIS TABLE

This patent application claims priority under 35 U.S.C. §120 as a continuation application to U.S. patent application Ser. No. 13/543,389 filed on Jul. 6, 2012 and issued as U.S. Pat. No. 9,480,897 and under 35 U.S.C. §119 to German Patent Application No 20 2012 001494.3 with a thing date of Feb. 14, 2012, which are both incorporated by reference in their entirety.

The present invention relates to a holding apparatus for a net of a table-tennis table. The present invention also relates to a table-tennis table.

Holding apparatuses and table-tennis tables of the aforementioned type are sufficiently known. One disadvantage of the table-tennis tables and holding apparatuses known from the prior art is that where the ground is uneven, the height of the two playing area surfaces ("leaves") can be misaligned with respect to each other.

The problem underlying the present invention is, consequently, to create a holding apparatus of the aforementioned type which can ensure, even in the case of irregular ground, that the playing area leaves are not misaligned with respect to each other. In addition, a table-tennis table of the aforementioned type is to be created where, even in the case of irregular ground, the playing area leaves are not misaligned with respect to each other.

These problems are solved by a holding apparatus of the aforementioned type as well as by a table-tennis table of the aforementioned type.

In embodiments of the holding apparatus, it is provided that the holding apparatus includes at least one blocking means which is arranged on one of the holding units and in the mounted state of the holding apparatus can be transferred into a blocking position in which it abuts against the under surfaces of the two playing area leaves. By the blocking means abutting against the under surface of the two playing area leaves, said playing area leaves are held substantially at the same height such that a misalignment can be extensively prevented.

It can be provided, in particular, that the holding apparatus includes two blocking means, one of which in each case is arranged on one of the two holding units. Consequently, a misalignment is counteracted on both sides of the table-tennis table.

It is possible for the blocking means to be able to be transferred out of a stowing position, in which it does not project under the playing area leaves, into the blocking position in which it abuts against the under surfaces of the two playing area leaves. In this case, it can be provided that the transferring of the blocking means out of the stowing position into the blocking position is effected by means of a movement, in particular a pushing movement, in a direction which is parallel to the direction in which the net extends between the two holding units in the mounted state of the holding apparatus. A pushing movement of this type brings about the abutment of the blocking means against the under surface of the playing area leaves using simple means.

It can also be provided that the blocking means has a guide portion which is, in particular, plate-shaped and can be moved in a guided manner in the holding unit. In this case, the at least one holding unit provided with the blocking means can have at least one recess, in which the blocking means, in particular the guide portion of the blocking means, can be moved in a guided manner. It is ensured in this way that the pushing movement for transferring the blocking means into the blocking position can be carried out and repeated in a simple manner.

It is possible for the blocking means to have at least one blocking portion which can abut against the under surface of at least one playing area leaf. In particular, the blocking means can have two blocking portions which can each abut against the under surface of one of the playing area leaves. Consequently, each of the playing area leaves is supported separately by one of the blocking portions.

It can also be provided that the at least one holding unit provided with the blocking means has at least one contact portion which, in the mounted state of the holding apparatus, can rest on the upper surface of at least one of the two playing area leaves. The two playing area leaves are consequently pressed or forced to the same height both from below and from above such that embodiments of the holding apparatus can prevent the height of the playing area leaves being misaligned with respect to each other in a very effective manner.

It is possible for the blocking means to have a gripping portion which the user can grip to move the blocking means. At the same time, the at least one holding unit provided with the blocking means can have at least one recess or opening in which the gripping portion is arranged so as to be accessible to the user. In this way, the gripping portion can be gripped and actuated in a simple manner by the user.

In particular, it can be provided in this case that the table-tennis table is developed in such a manner that prior to transferring the table-tennis table into the stowing position, the blocking means has to be transferred out of the blocking position into the stowing position.

Further features and advantages of the present invention become clear by way of the following description of preferred exemplary embodiments with reference to the attached Figures, in which.

Identical or functionally identical parts are provided with identical references in the Figures.

Figure 1:
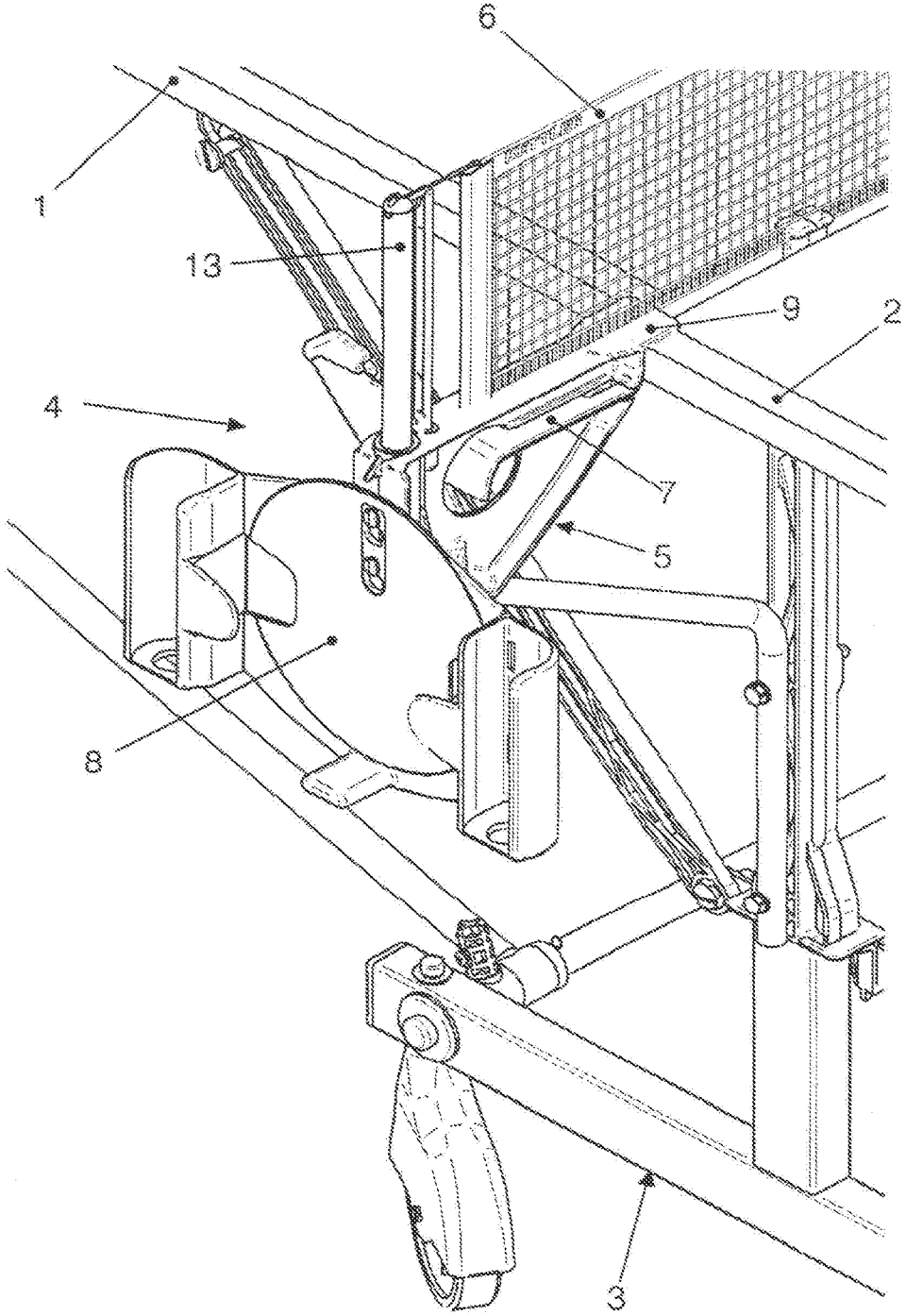
FIG. 1 shows a perspective view of a detail of a table-tennis table as claimed in the invention with a holding apparatus as claimed in the invention which is located in a stowing position.

The embodiment of a table-tennis table of the invention that can be seen from FIG. 1 includes two playing area leaves 1, 2 and an underframe 3 which can support and hold the playing area leaves 1, 2 in the playing position shown in FIG. 1 in such a manner that together they form a continuous horizontal playing area. In addition, the underframe 3 is realized in such a manner that the playing area leaves 1, 2 are transferable out of the horizontal playing position into a vertical stowing position.

The table-tennis table shown also includes a holding apparatus 4 with two holding units 5, just one of which is shown. On opposite sides of the playing area, the holding units 5 hold a net 6 which extends between them along the connecting line between the two playing area leaves 1, 2.

Figure 2:
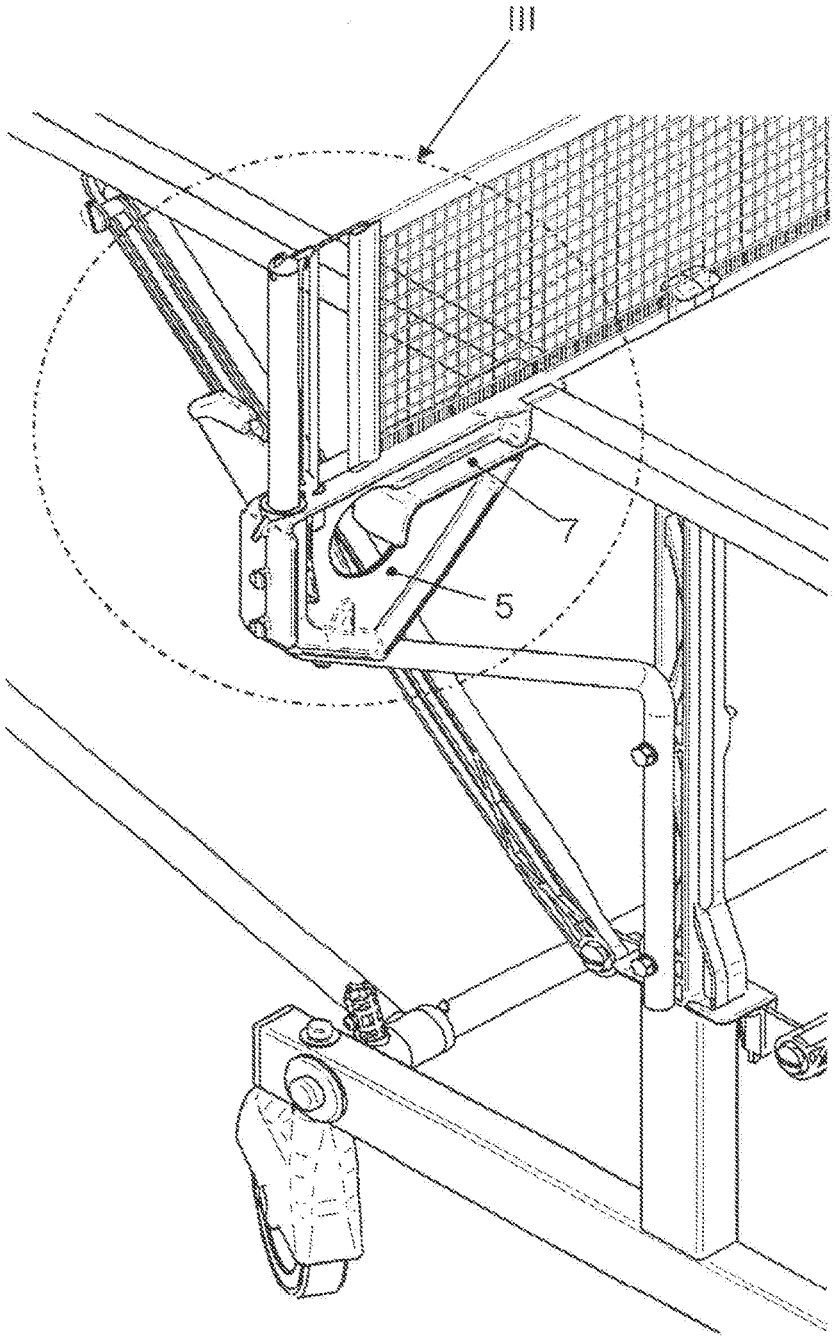
FIG. 2 shows a perspective view of a detail of a table-tennis table as claimed in the invention with a holding apparatus as claimed in the invention which is located in a blocking position.
Figure 3:
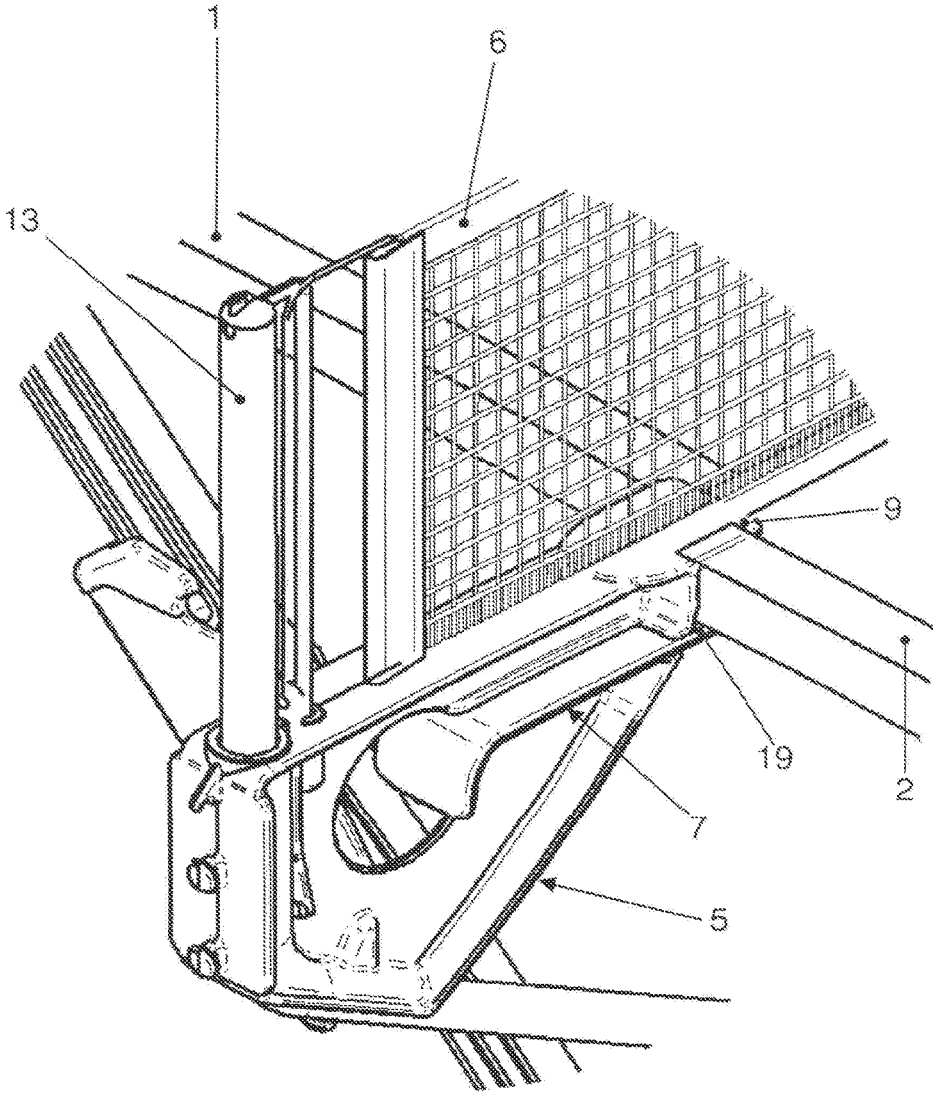
FIG. 3 shows a view of the detail according to the arrow III in FIG. 2.
Figure 4:
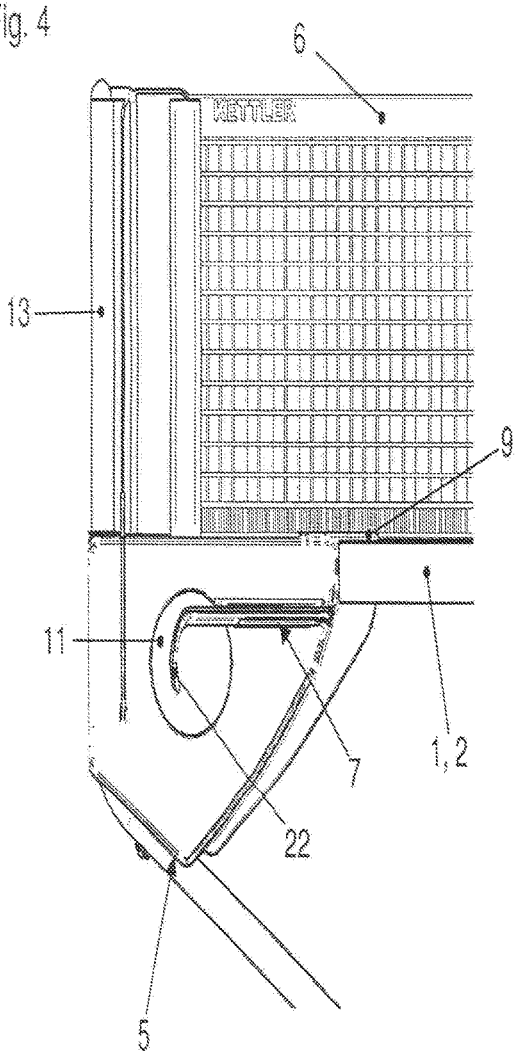
FIG. 4 shows a side view of a table-tennis table as claimed in the invention with a holding apparatus as claimed in the invention which is located in a stowing position.
Figure 5:
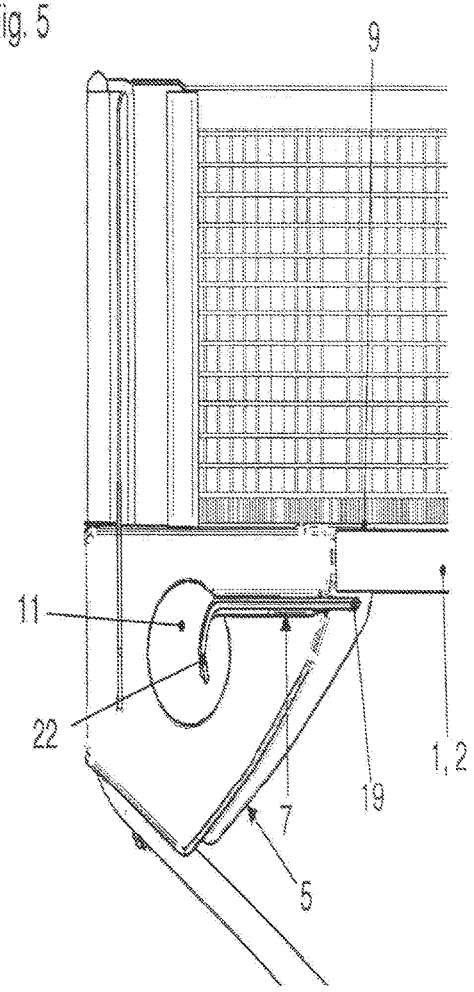
FIG. 5 shows a side view of a table-tennis table as claimed in the invention with a holding apparatus as claimed in the invention which is located in a blocking position.

A blocking means 7, which can be transferred out of a stowing position, in which it does not project under the playing area leaves 1, 2 (see FIG. 1 and FIG. 4), into a blocking position in which it abuts against the under surfaces of the two playing area leaves 1, 2 (see FIG. 2, FIG. 3 and FIG. 5), is mounted in each case so as to be movable in each one of the holding units 5.

In the case of the embodiment according to FIG. 1, the table-tennis table also includes a bat-and-ball-holding unit 8 which is mounted on the sides of one of the holding units 5 facing away from the net 6. Said bat-and-ball-holding unit 8 is of no importance to the present invention and is consequently not explained in any more detail in the following description.

Figure 8:
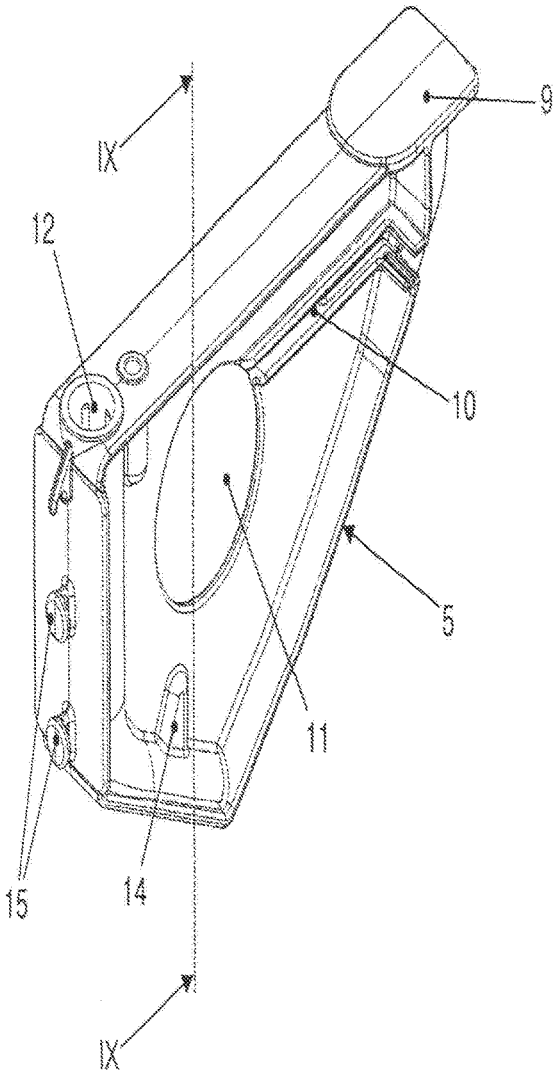
FIG. 8 shows a perspective view of a holding unit of a holding apparatus as claimed in the invention.
Figure 9:
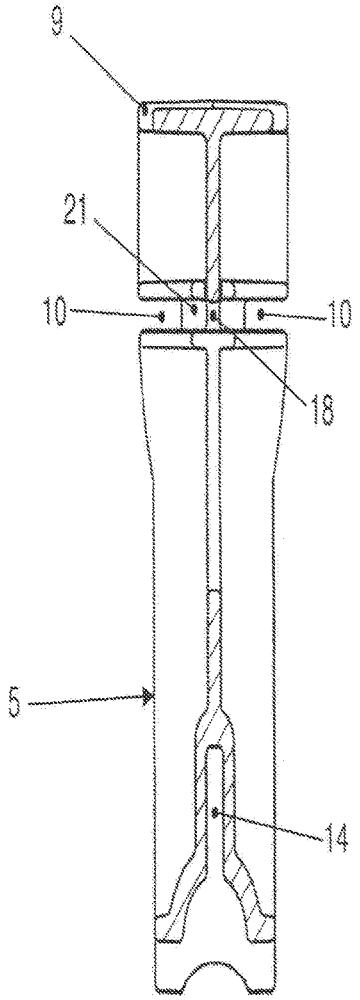
FIG. 9 shows a sectional view according to the arrow IX in FIG. 8.

One of the holding units 5 can be seen in detail from FIG. 8 and FIG. 9. The holding unit 5 shown is realized as a flat elongated body. It has a contact portion 9 which, in the mounted state of the holding apparatus 4, can rest on the upper surface of both playing area leaves 1, 2 (see also FIG. 1 in this respect).

The holding unit 5 also has two recesses 10, in which a portion of the blocking means 7 can be guided. In particular, said recesses 10 are open toward the side facing the playing area leaves 1, 2 in the installed state such that the blocking means 7 is able to protrude here. In addition, the holding unit 5 has an opening 11 with an outline which, in particular, is circular and in which a portion of the blocking means 7 is accessible to the user and is able to be gripped.

In addition, a vertical bore 12 for the accommodation of a rod 13 (see FIG. 1) mounted at the end of the net 6 is arranged on the side remote from the playing area leaves 1, 2 in the installed state. In addition, the holding unit 5 has connecting regions 14, 15 for the attachment of the underframe 3 and of the bat-and-ball-holding unit 8.

Figure 6:
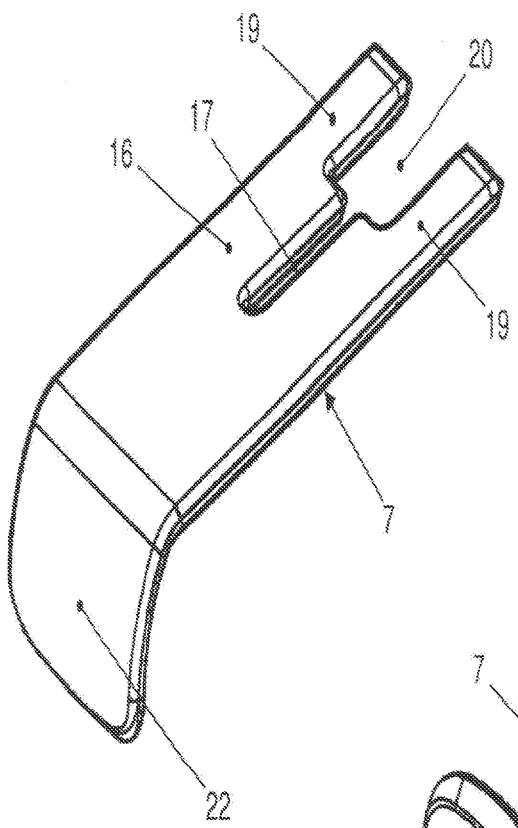
FIG. 6 shows a perspective view of a blocking means of a holding apparatus as claimed in the invention.
Figure 7:
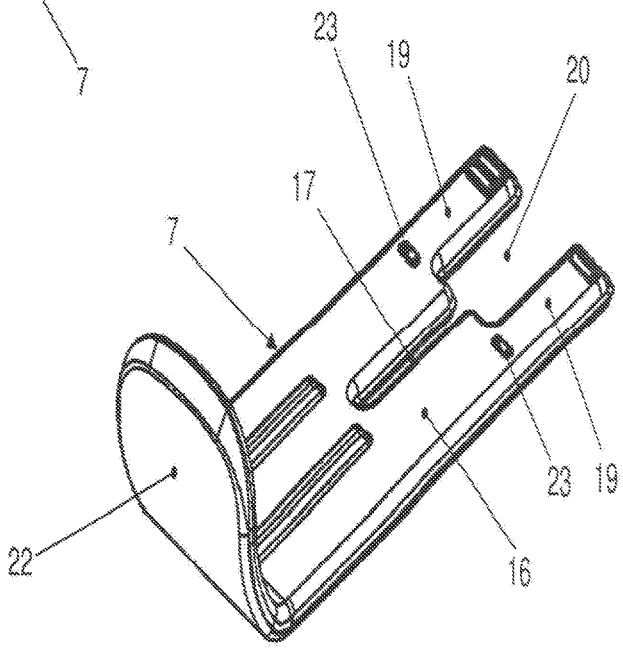
FIG. 7 shows a perspective view of the blocking means according to FIG. 6 rotated by 180° in relation to FIG. 6.

A blocking means 7 can be seen in detail from FIG. 6 and FIG. 7. The blocking means 7 is realized as a flat locking bar with a reversed end. The blocking means 7 has a central guide portion 16 which is essentially plate-shaped and can be guided in the recesses 10. The guide portion 16 has in part a slot 17, in which a web 18 of the holding unit 5 can engage.

In the installed state two blocking portions 19, which abut against the under surfaces of the two playing area leaves 1, 2 in the blocking position, connect to the guide portion 16 on the side facing the playing area leaves 1, 2. The two blocking portions 19 are spaced apart with respect to each other in the transverse direction. The space 20 formed as a result is able to accommodate an end-side part 21 of the holding unit 5 (see also FIG. 9).

On the side of the guide portion 16 remote from the blocking portions 19, the blocking means 7 also has a gripping portion 22, which corresponds to the end of the blocking means 7 projecting out of the plane of the guide portion 16. In the mounted state, the gripping portion 22 is arranged in the opening 11 such that it is able to be gripped by the user (see, for example, FIG. 4 and FIG. 5). In particular, the rear surface of the gripping portion 22 and the inside surface of the opening 11 can have, in an approximate manner, a comparable curvature or a comparable radius such that the blocking means 7 can be pulled comparatively far from the playing area leaves 1, 2 or can be moved to the left in FIG. 4 and FIG. 5.

On its lower side in the position of use, the blocking means 7 also has a plurality of anti-removal cams 23.

For transferring the blocking means 7 from the stowing position (see FIG. 4) into the blocking position (see FIG. 5), the user can grip the gripping portion 22 and push the blocking means 7 in the direction of the playing area leaves 1, 2 until the two blocking portions 19 abut against the under surfaces of the playing area leaves 1, 2. Because the contact portion 9 rests on the upper surface of the two playing area leaves 1, 2 at the same time, said playing area leaves are made to align with each other in the horizontal direction or are made not to have any difference in height.

The anti-removal cams 23 prevent the blocking means 7 transferring automatically out of the blocking position into the stowing position. The blocking means 7 can only be pulled out of the blocking position by the user exerting a considerable force onto the gripping portion 22.

The invention claimed is:

1. A table tennis table, comprising:

a first playing surface leaf and a second playing surface leaf;

an underframe hingedly connected to the first playing surface leaf and the second playing surface leaf, wherein the underframe is hingedly supporting the first playing surface leaf and hingedly supporting the second playing surface leaf such that the first playing surface leaf and the second playing surface leaf are transferable between a horizontal playing position into a vertical stowing position;

a first holding unit and a second holding unit connected to opposite sides of the underframe, wherein the first holding unit and the second holding unit hold a table tennis net in a playing position extending between the first holding unit and the second holding unit along a connecting line between the first playing surface leaf and a second playing surface leaf in the horizontal playing position; wherein the first holding unit comprises:

a body, a table tennis net support post connected to the body, two recesses defined by the body, a first contact portion which rests on an upper surface of the first playing surface leaf and the second playing surface leaf with the table tennis table in the horizontal playing position, an opening defined by the body and connected to the two recesses, and blocking means slidably connected to the body of the first holding unit, wherein the blocking means comprises:

a guide portion slidingly supported and guided in the body within the two recesses, a gripping portion projecting out of a plane of the guide portion, the gripping portion arranged within the opening, wherein a rear surface of the gripping portion and the opening have an approximately comparable curvature such that the blocking means can be pulled sufficiently away from the playing surface leaves to be transferred from a blocking position in which the blocking means abuts against the under surfaces of the playing surface leaves to a stowing position, in which the blocking means does not project under the surface leaves relative to the body.

2. The table tennis table of claim 1, wherein the blocking means extends from the opening in the body through the recesses to a playing surface side of the body.

3. The table tennis table of claim 1, wherein the blocking portion comprises a first blocking portion connected to a first end of the guide portion, a second blocking portion connected to the first end of the guide portion.

4. The table tennis table of claim 3, wherein the first blocking portion abuts the first playing surface leaf and the second blocking portion contacts the second playing surface leaf.

* * * * *